United States Patent [19]

Taira

[11] 4,212,001

[45] Jul. 8, 1980

[54] ELECTRIC HORN

[75] Inventor: Toshiji Taira, Toyota, Japan

[73] Assignee: Nippondenso Co., Ltd., Kariya, Japan

[21] Appl. No.: 818,668

[22] Filed: Jul. 25, 1977

[30] Foreign Application Priority Data

| | | | |
|---|---|---|---|
| Aug. 31, 1976 | [JP] | Japan | 51-117534[U] |
| Sep. 2, 1976 | [JP] | Japan | 51-118192[U] |
| Dec. 16, 1976 | [JP] | Japan | 51-169085[U] |

[51] Int. Cl.[2] ..... G10K 9/00

[52] U.S. Cl. ..... 340/388; 340/384 R

[58] Field of Search ..... 340/388, 384 R, 391, 340/402

[56] References Cited

U.S. PATENT DOCUMENTS

| | | | |
|---|---|---|---|
| 1,328,454 | 1/1920 | Root | 340/388 |
| 1,799,162 | 4/1931 | Goldschmidt | 340/388 |
| 2,645,768 | 7/1953 | Santino | 340/388 |
| 2,700,761 | 1/1955 | White | 340/388 |
| 2,942,255 | 6/1960 | Wetzel | 340/388 |
| 3,041,601 | 6/1962 | Wetzel | 340/388 |
| 3,179,932 | 4/1965 | Gregoroff | 340/388 |
| 3,456,254 | 7/1969 | Dougall | 340/388 |
| 3,562,748 | 9/1968 | Wetzel et al. | 340/388 |
| 3,886,546 | 1/1975 | Ueda | 340/388 |

*Primary Examiner*—James D. Thomas
*Assistant Examiner*—Joel Miller
*Attorney, Agent, or Firm*—Cushman, Darby & Cushman

[57] ABSTRACT

In an electric horn for an automobile, a diaphragm is bent at its periphery to define an effective vibration area and a flange portion of a housing is also bent to hold the peripheral edge of the diaphragm. As a result, good sound and sealing are ensured in a compact structure with less number of parts.

1 Claim, 9 Drawing Figures

ELECTRIC HORN

BACKGROUND OF THE INVENTION

The present invention relates to an improvement in fixing of a diaphragm to a horn housing of an electric horn for an automobile.

In a conventional electric horn, a horn housing encasing an electromagnetic coil and a breaker and a diaphragm are fixed by screws or rivets at a plurality of peripheral portions of the diaphragm. In such a construction, it is difficult for the diaphragm to have even fixing pressure which is essential for good sound. Further, such a diaphragm must have considerably a large flange portion to carry such screws or rivets thereon.

SUMMARY OF THE INVENTION

Therefore, it is a main object the present invention to provide an improved compact electric horn of a good sound.

It is another object of the present invention to provide an improved electric horn with less assembling parts and works.

It is a further object of the present invention to provide an improved electric horn comprising a diaphragm with the bent periphery which outer portion is held from outside by the flange of a horn housing, which may ensure a good sealing.

It is still a further object of the present invention to provide a vent at the bent periphery of the diaphragm, which ensures effective ventilation without affecting sound characteristics.

DETAILED DESCRIPTION OF THE PREFERRED EMBODIMENT

The present invention will be explained with reference to the attatched drawings.

Figure 1:
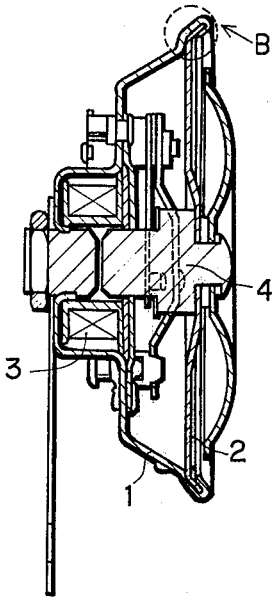
FIG. 1 is a sectional side view of an electric horn according to the present invention.

In FIG. 1, a horn housing 1 holds at its periphery a diaphragm 2. The housing encases a electromagnet 3 which is known in the art and other known parts including a breaker and a magnetic core, all of which form a vibratory mechanism.

Figure 2:
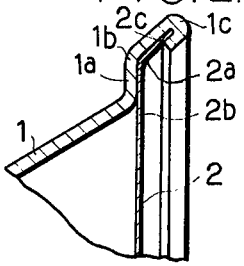
FIG. 2 is an enlarged frangmental sectional view of the electric horn shown in circle B in FIG. 1.

The diaphragm 2 carries at its central portion an armature 4. As shown in FIG. 2 which shows the encircled portion indicated by B in FIG. 1, the entire outer periphery of the diaphragm 2 is formed to have a bent portion 2*a* whose bent angle is greater than 90° and the edge 2*c* of the bent portion 2*a* is wrapped from outside by the bent portion 1*c* of the flange 1*b* of the housing 1.

It is noted that the more obtuse the bent angle is formed, the less strain is applied on the diaphragm 2, and that since the diaphragm 2 is fixed to the housing 1 outside the bent portion 2*a* which defines an effective area of vibration, little adverse effects of the fixing such as deformation of the diaphragm is brought to the effective vibrating area of the diaphragm 2. As a result, excellent vibration, that is, excellent sound may be ensured.

Further, the above construction eliminates screws or rivets for fixing, thereby eliminating comparatively larger space for the fixing by screws or rivets to result in a compact electric horn.

In addition, a thinner housing may be employed with better sealing effect.

Instead of holding the diaphragm peripheral edge by the housing flange, welding same to the housing flange is also effective to the fixing.

Figure 3:
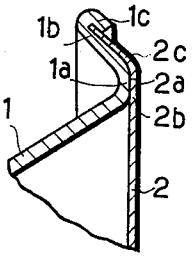
FIG. 3 is an enlarged fragmental sectional view of a modified embodiment according to the present invention.

FIG. 3 shows a modified way of fixing. This construction brings substantially the same effect as the above on the electric horn.

Figure 4:
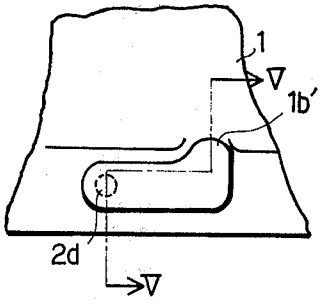
FIG. 4A is a fragmentary perspective view of a section of the horn housing showing the bulge formed in the flanged portion and FIG. 4B is a view similar to FIG. 4A but showing a portion of the diaphragm having an aperture over the bulge formed in the housing.
Figure 4A:
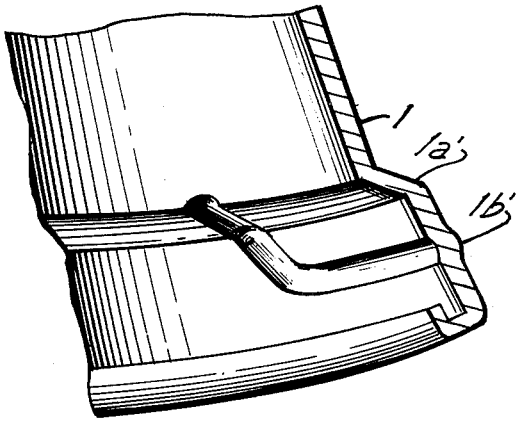
Figure 4B:
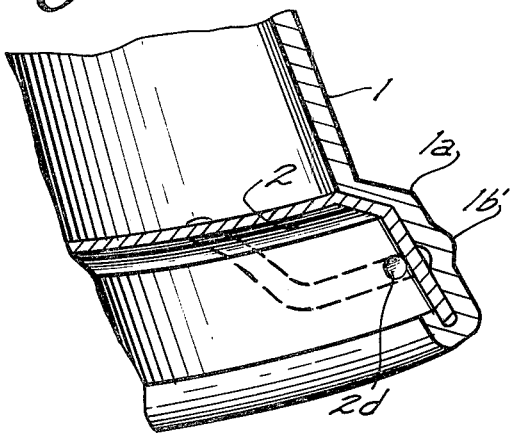
Figure 5:
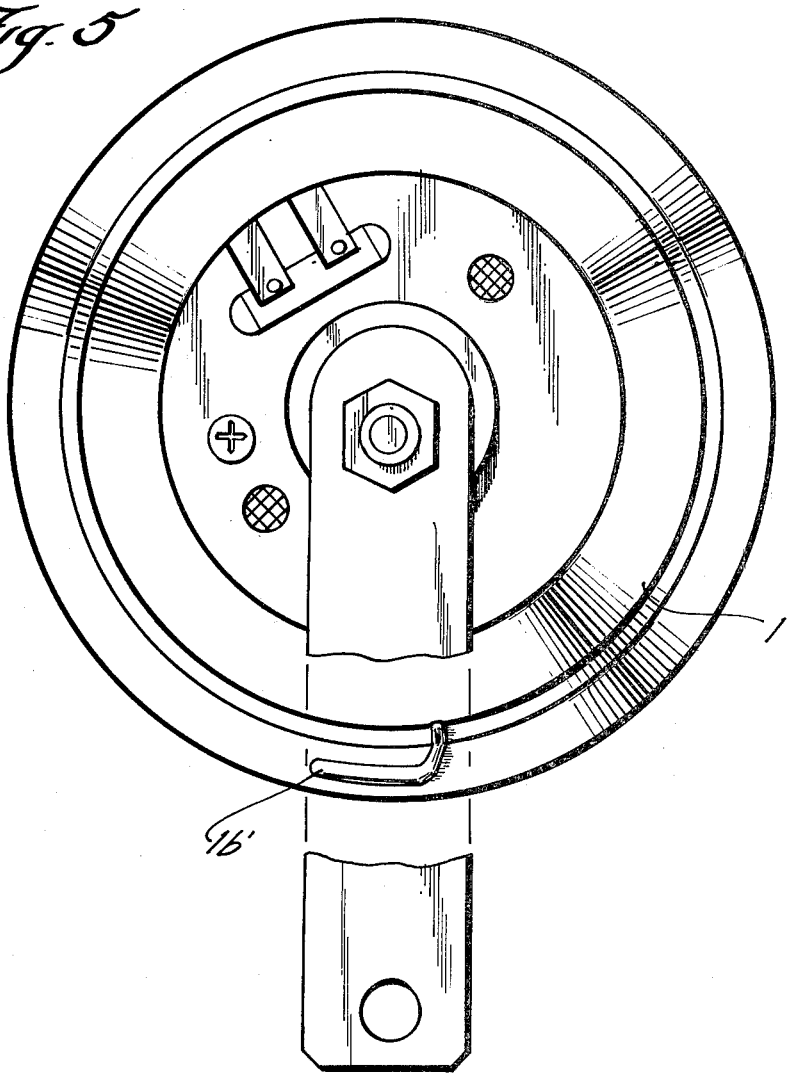
FIG. 5 is a rear view in elevation with parts broken away showing the location of the bulge in the flange of the horn of the present invention.

As shown in FIGS. 4A and 4B, a vent 2*d* may be formed in the area of the bent portion 2*a* of the diaphragm 2 with a bulge 1*b*′ being formed on the corresponding flange portion of the housing to provide an air passage between the inside wall of the bulge 1*b*′ and the bent portion 2*a* which communicates the inside of the housing 1 with the atmosphere. The passage is effective for cooling the vibratory mechanism, and drain of water if it is provided at the lowest portion of the housing as shown in FIG. 5.

It is noted that since the vent is formed outside the effective vibration area, it does not adversely affect the vibration of the diaphragm.

Figure 6:
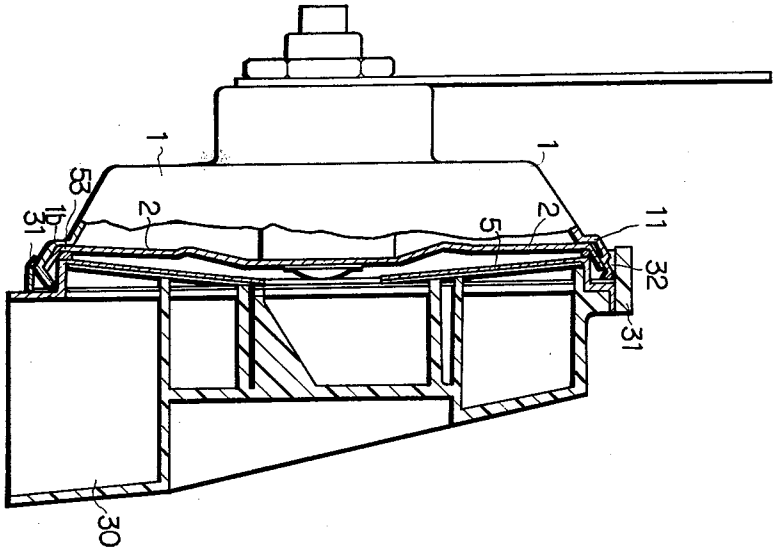
FIG. 6 is a sectional side view of another embodiment.

FIG. 6 shows as another embodiment of the present invention a trumpet type electric horn.

In this embodiment, the bent peripheral edge of the diaphragm 2 is also held by the flange portion 1*b* of the housing 1, however, more lightly than the previous embodiments so that uneven strain exerted on the diaphragm by the fixing may be further reduced.

Instead, a plurality of high resilient hooks 31 of trumpet 30 which comprises a vortical acoustic member made of synthetic resin and a plate member 5 holds the housing 1 at its periphery thereof with an elastic ring 53 being interposed to be compressed between the plate member 5 and the diaphragm over the peripheral area thereof. The hook 31 and housing flange 1*b* are formed respectively with projections 32 and 11 to snugly fit each other. The hook 31 is further provided with a groove (not shown) which holds both sides of the projection 11 to prevent the trumpet 30 from turning with respect to the housing 1.

What is claimed is:

1. An electric horn comprising:

a cup-shaped housing having a peripheral edge shaped to form a bent flange portion and a bulge having an inside wall formed in said bent flange portion and extending from the interior of said housing to a point on said flange portion spaced from the interior of said housing to provide an air passage therein, a diaphragm member disposed in said housing and including a substantially flat central portion having a surface facing outwardly of said housing and a bent peripheral portion extending from said flat central portion at an angle greater than 90° with respect to said surface, said bent flange portion engaging said bent peripheral portion of said diaphragm member on the exterior thereof to hold said diaphragm member in said housing, said bent peripheral portion having a vent formed therein opening into the inside wall of said bulge in said bent flange portion so that the inside of said housing is communicated with the atmosphere through the inside of said bulge and said vent in said bent peripheral portion of said diaphragm, and means disposed in said housing for driving said diaphragm.

* * * * *